US006007365A

United States Patent [19]

Atsumi et al.

[11] Patent Number: 6,007,365

[45] Date of Patent: Dec. 28, 1999

[54] PRESSURE CONTACT TERMINAL FITTING

[75] Inventors: Keigo Atsumi; Masahiko Aoyama; Hitoshi Okumura; Mitsugu Furutani, all of Yokkaichi, Japan

[73] Assignee: Sumitomo Wiring Systems, Ltd., Japan

[21] Appl. No.: 08/978,284

[22] Filed: Nov. 25, 1997

[30] Foreign Application Priority Data

Nov. 26, 1996 [JP] Japan ..... 8-314950

[51] Int. Cl.[6] ..... H01R 4/24

[52] U.S. Cl. ..... 439/397; 439/406

[58] Field of Search ..... 439/397, 399

[56] References Cited

U.S. PATENT DOCUMENTS

| | | | |
|---|---|---|---|
| 4,693,532 | 9/1987 | Colleran et al. | 439/405 |
| 5,000,698 | 3/1991 | Kuzuno | 439/395 |
| 5,133,672 | 7/1992 | Nelligan, Jr. et al. | 439/399 |
| 5,139,434 | 8/1992 | Goodman | 439/399 |
| 5,380,218 | 1/1995 | Yamamoto et al. | 439/397 |
| 5,588,868 | 12/1996 | Tsuji et al. | 439/397 |
| 5,591,044 | 1/1997 | Abe et al. | 439/397 |

FOREIGN PATENT DOCUMENTS

WO 90 05392 5/1990 WIPO .

*Primary Examiner*—Michael L. Gellner
*Assistant Examiner*—Briggitte R. Hammond
*Attorney, Agent, or Firm*—Banner & Witcoff, Ltd.

[57] ABSTRACT

An electrical terminal has inwardly directed blades (21,22) to cut through insulation and make contact with an electrical core wire. Two sets of axially spaced blades are provided to increase security. The front set of blades (21) is bent in from opposite sides whereas the rear set is bent up from the base. This configuration gives a short terminal length without risk of deformation when the usual wire barrels (13) are crimped.

6 Claims, 3 Drawing Sheets

PRESSURE CONTACT TERMINAL FITTING

TECHNICAL FIELD

The present invention relates to a pressure contact electrical terminal fitting.

BACKGROUND TO THE INVENTION

The interior of a pressure contact electrical terminal fitting is provided in a unified manner with pressure contact blades which define a groove therebetween. When an electric wire is inserted into the groove, the blade edges cut through the insulating covering of the electric wire and thereby make contact with the conductive core. In this manner, the pressure contact terminal fitting allows electrical contact between the electric wire and the terminal fitting. Such a pressure contact terminal fitting has the advantage of not requiring a shaving process for exposing the end of a core wire, which is required in the case of a terminal fitting in which the core wire is connected by crimping or soldering of a barrel.

FIG. 6 of the accompanying drawings shows a conventional pressure contact terminal fitting. A terminal fitting 40 has two pairs of pressure contact blades 45, formed anteriorly and posteriorly, and located inside a pressure contact member 41 whose upper face is open and forms a channel, facing side walls 42 thereof being sheared out so as to form a pair of mutually facing protruding members 43 which constitute the pressure contact blades 45. A pressure contact groove 44 is formed between the protruding members 43. The reason for providing two pairs of blades 45 is that the core wire normally consists of a plurality of thin intertwined wires, and providing only one pair of blades 45 can result in the core wire becoming unwound after making pressure contact, and this can cause the core wire to escape the groove 44 or otherwise reduce the electrical contacting force. If two pairs of pressure contact blades 45 are provided, the unwinding and poor contact are prevented from occurring, and the reliability of the electric contact increases.

In the pressure contact terminal fitting 40 having the configuration described above, the protruding members 43 which form the pressure contact blades 45 are sheared out from the side plates 42. However, the sides walls 42 are formed in a unified manner with barrels 46 which serve to fix the electric wire by being crimped around the posterior end of the pressure contact portion of the electric wire. Consequently, due to the barrels 46 being crimped, the side walls 42 have a tendency to change shape by bending, resulting in a slight change in the width of the pressure contact groove 44. This adversely affects the reliability of the pressure contact.

FIG. 7 shows a different type of prior pressure contact terminal fitting. A terminal fitting 50 has two pressure contact blades 53 formed anteriorly and posteriorly by shearing out of a base plate 54 of a pressure contact member 51, the blades 53 having pressure contact grooves 52 formed thereon. In this configuration, since the pressure contact blades 53 are cut out from the base plate 54, even if the side walls 55 bend in accompaniment with the crimping by the barrel 56, the accuracy of the dimension of the pressure contact grooves 52 remains unaffected by the bending, resulting in a higher reliability of contact compared to the terminal fitting 40 of FIG. 6. However, since the two pressure contact blades 53 are sheared out from the base plate 54, there is a problem in that the total length of the base plate 54, that is, the length of the terminal fitting 50, becomes larger than that of the other prior terminal fitting 40.

Both the terminal fitting 40 of FIG. 6 and the terminal fitting 50 of FIG. 7 have their own advantages and shortcomings; consequently a further improvement seems desirable. The present invention has been developed after taking the above problems into consideration, and aims to maintain a short length while achieving a highly reliable pressure contact.

SUMMARY OF THE INVENTION

According to the invention there is provided a pressure contact terminal fitting comprising a base and two upstanding side walls defining a channel, and a crimping barrel at one end of said channel, the terminal fitting further including two pairs of opposed blades adapted to receive an electrical wire, a first pair of said blades being nearer said crimping barrel and part-sheared out of said base, and a second pair of said blades being further from said crimping barrel and part-sheared one each out of said side walls.

Such a terminal fitting has the advantage that the rearmost blades (adjacent the crimping barrel) are not susceptible to deformation when the crimping barrel is crimped. Furthermore the frontmost blades are sheared out of respective side walls which keeps the terminal short whilst also distributing the consequent apertures around the terminal. This latter advantage contributes to the reduction in localised stress and gives a balanced distribution through the terminal.

Preferably the rearmost blades are bent up towards the crimping barrel whereas the front most blades are bent in away from the crimping barrel.

BRIEF DESCRIPTION OF DRAWINGS

Other features of the present invention will be apparent from the following description of a preferred embodiment shown by way of example only in the accompanying drawings in which.

DESCRIPTION OF PREFERRED EMBODIMENTS

A first embodiment of the present invention is explained hereinbelow, with reference to FIGS. 1 to 5.

Figure 1:
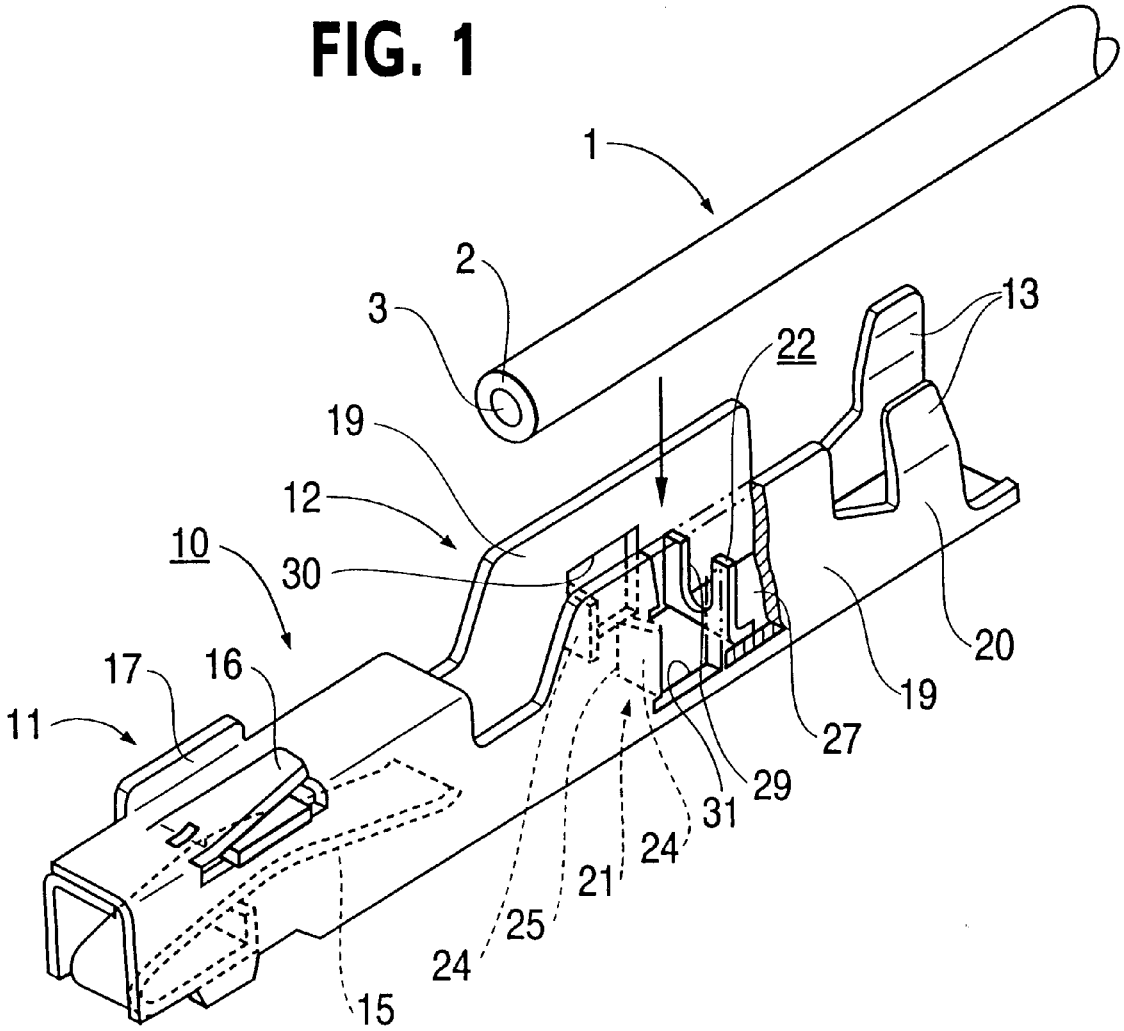
FIG. 1 is a diagonal view of a first embodiment showing a state prior to the insertion of a wire.

The present embodiment applies to a female pressure contact terminal fitting formed by first cutting and then shaping an electrically conductive metal plate into the configuration shown in FIG. 1. The terminal fitting 10 comprises, in sequence from the anterior end towards the posterior end: a connecting member 11 which connects with a corresponding male terminal fitting (not shown); a pressure contact member 12 whose upper face is open, forming a groove shape, the pressure contact member 12 making pressure contact with a terminal end of an electric wire 1; and barrels 13 for crimping to the posterior end of the pressure contact portion of the electric wire 1.

The connecting member 11 provided at the anterior end has an angular tube shape with a two-layered roof face. Its interior has a resilient contact member 15 that can make contact in a resilient manner with a tab member of a corresponding male terminal fitting. Further, a lance 16 is formed by cutting away the roof face. When the terminal fitting 10 is inserted into a cavity of a connector housing (not shown), the lance 16 is stopped by a stopping member located inside the cavity, and the terminal fitting 10 is retained in an unremovable state. Along with this, one edge of the roof face has a stabilizer 17 for preventing the terminal fitting 10 from being inserted the wrong way and for maintaining a stable insertion in a housing (not shown).

The barrels 13 are provided as a pair at the rear end so as to protrude upwards from side walls 20 which extend from side walls 19 of the pressure contact member 12. The barrels 13 are slightly displaced with respect to each other in an anterior-posterior direction.

Figure 4:
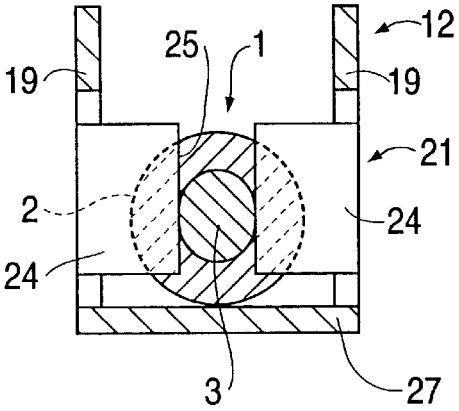
FIG. 4 is a cross-sectional view along the line X—X in FIG. 3.

The pressure contact member 12 has pressure contact blades 21 and 22 located in the anterior and posterior. As shown in FIG. 4, the anteriorly located pressure contact blades 21 are formed by part-shearing inwards a pair of protruding members 24 which extend from mutually facing left and right side walls 19 of the pressure contact member, the protruding members 24 facing each other. A pressure contact groove 25 is formed between the protruding edges of the protruding members 24. The width of the pressure contact groove 25 is set at a specified dimension that is somewhat smaller than the diameter of a core wire 3 of the electric wire 1.

Figure 2:
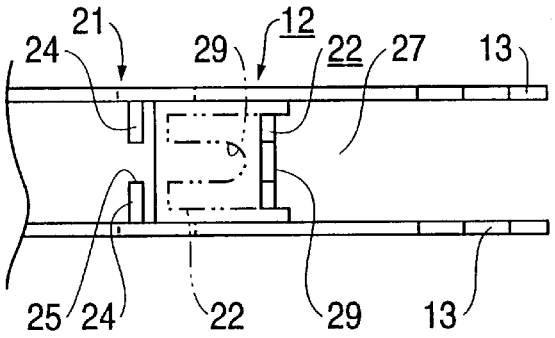
FIG. 2 is a partial plan view of the first embodiment.

As shown by the broken line in FIG. 2, the pressure contact blade 22 located in the posterior is formed by part-shearing it out from the base plate 27 of the pressure contact member 12 with a pressure contact groove 29 already formed on the pressure contact blade 22. The base end of the pressure contact blade 22 is then bent so that the pressure contact blade 22 faces up at a right angle with respect to its original position. A specified distance is maintained with respect to the anteriorly located pressure contact blades 21. The width of the pressure contact groove 29 in the pressure contact blade 22 is the same as that of the pressure contact groove 25 of the anterior pressure contact blade 21.

Next, the pressure contact process of the electric wire is explained.

Figure 3:
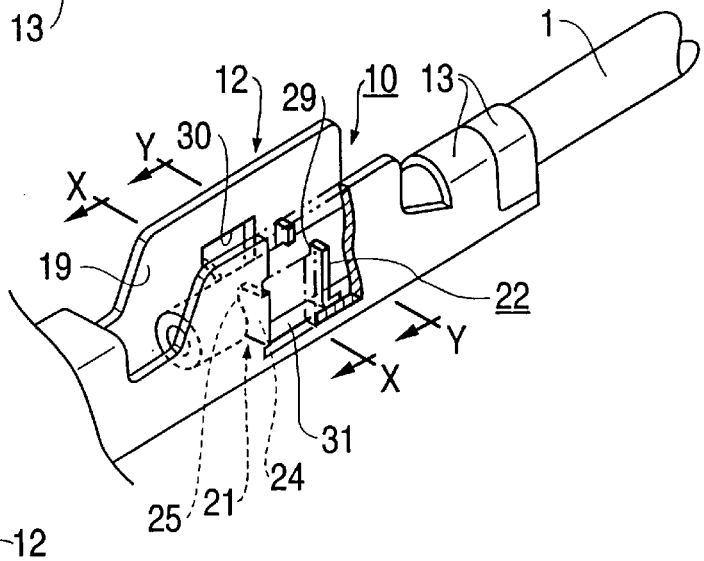
FIG. 3 is a diagonal view of the first embodiment showing an inserted wire.
Figure 5:
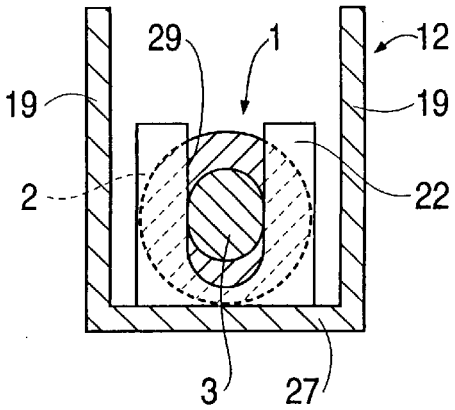
FIG. 5 is a cross-sectional view along the line Y—Y in FIG. 3.
Figure 6:
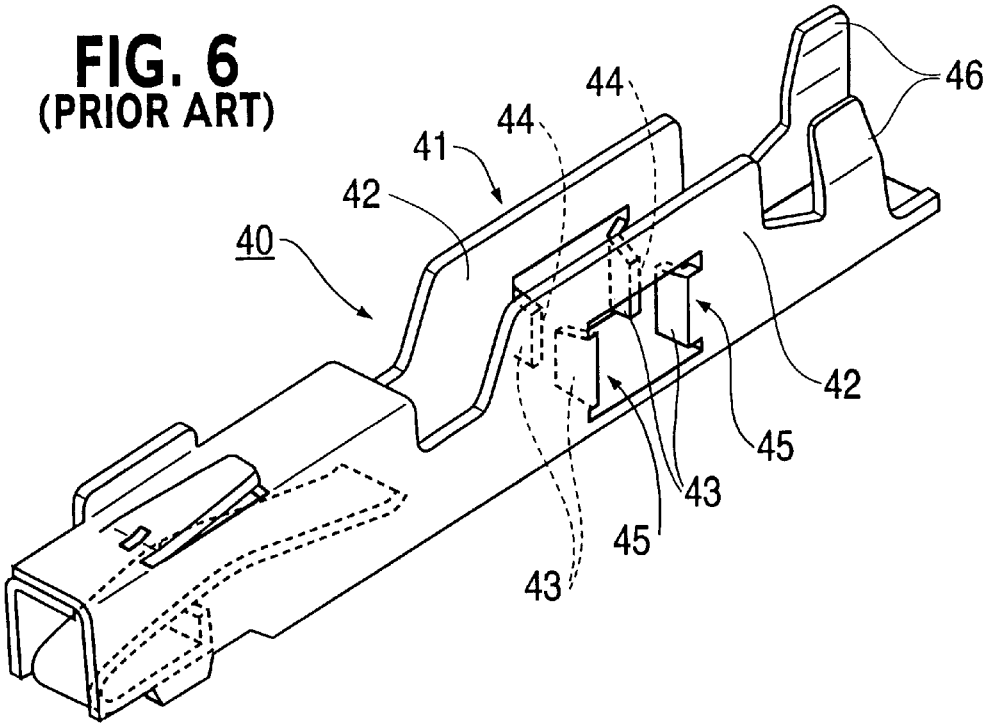
FIG. 6 (PRIOR ART)
FIG. 6 is a diagonal view of a prior art connector.
Figure 7:
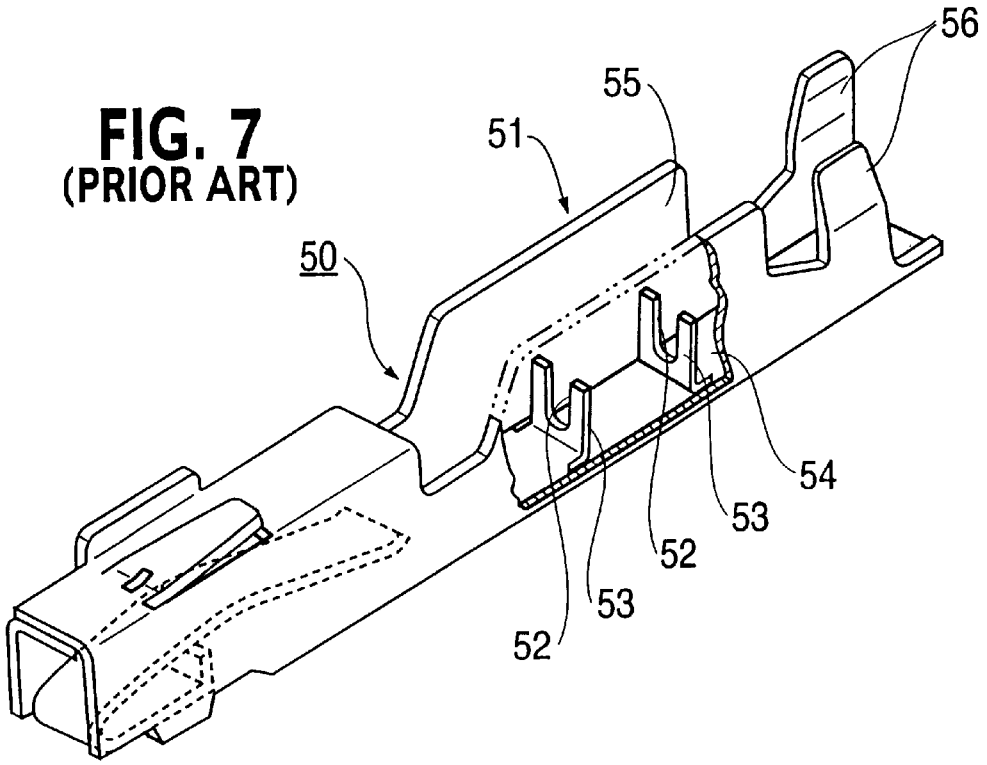
FIG. 7 (PRIOR ART)
FIG. 7 is a diagonal view of another prior art connector.

As shown by the arrow in FIG. 1, the terminal end of the electric wire 1 is inserted towards the pressure contact blades 21 and 22 from the upper face of the terminal fitting 10. As shown in FIGS. 4 and 5, due to the pressure contact blades 21 and 22 located in the anterior and posterior, a covering 2 of the electric wire 1 is cut into by the edges of the pressure contact grooves 25 and 29, and the core wire 3 makes contact with the edges of the pressure contact grooves 25 and 29. In this manner, the electric wire 1 and the terminal fitting 10 make electrical contact via the two pressure contact blades 21 and 22 located in the anterior and posterior. Next, the pair of barrels 13 provided at the posterior of the pressure contact member 12 are crimped onto the electric wire 1 so as to surround it. As shown in FIG. 3, this results in the terminal fitting 10 becoming fixed with respect to the electric wire 1.

When pressure contact occurs as described above, the accuracy of the dimension of the pressure contact groove 29 is high from the very outset since it is formed beforehand in the posteriorly located pressure contact blade 22 by shearing away the base plate 27. Furthermore, since the pressure contact blades 21 are formed by shearing away the protruding members 24 from the left and right side plates 19, and since the pressure contact blades 21 are located towards the anterior and at a distance from the barrels 13, when the barrels 13 are crimped, the side plates 19 remain unaffected by the bending of the barrels 13, and the dimension of the pressure contact groove 25 remains relatively accurate. In this manner, a highly reliable pressure contact can be maintained for the electric wire 1. Moreover, since the pressure contact blades 21 and 22 are formed separately by cutting away from the side plates 19 and the base plate 27, compared to the case where two pressure contact blades are sheared out from the base plate 27, the length of the pressure contact member 12, that is, the length of the terminal fitting 10, can be made shorter. Furthermore, the openings 30 and 31, formed after shearing out away the pressure contact blades 21 and 22, are distributed between the side plates 19 and the base plate 27, thereby maintaining a balanced strength with respect to the pressure contact member 12.

The present invention is not limited to the embodiments described above with the aid of figures. For example, the possibilities described below also lie within the technical range of the present invention. In addition, the present invention may be embodied in various other ways without deviating from the scope thereof.

(1) In the case where the pressure contact blades are formed by cutting away protruding members from the side plates, it may equally be arranged that the opening due to the cutting away appear to the front of the protruding members. Further, in the case of the pressure contact blade formed by cutting away from the base plate, the cutting away may equally be carried out so that the opening appears to the rear side of the pressure contact blade.

(2) The present invention may equally be applied to a male pressure contact terminal fitting, as opposed to the embodiment described above, where the application to a female pressure contact terminal fitting is described.

We claim:

1. A pressure contact terminal fitting comprising a base and two upstanding side walls defining a channel, and a crimping barrel at one end of said channel, the terminal fitting further including two pairs of opposed blades in the channel to receive an electrical wire, a first pair of said blades being near said crimping barrel and part-sheared out of said base as an upstanding, unitary planar member having an open ended slot in a upper free end of the planar member to receive the wire, and a second pair of said blades being further from said crimping barrel than said first pair of blades and formed such that one of said second pair of blades is part-sheared out of each of said side walls as an inwardly turned planar member, wherein said planar members of said second pair of blades are aligned and spaced apart to define a slot therebetween for receiving the wire, and wherein a first opening in the base formed by part-shearing the first pair of blades overlaps in a longitudinal direction a pair of second openings the side walls formed by part-shearing the second pair of blades, whereby the length of the channel and localized stress in the terminal fitting can be minimized.

2. The fitting according to claim 1 wherein each blade of said second pair of blades is bent out of a respective side wall in the direction away from said crimping barrel.

3. The fitting according to claim 1 wherein said second pair of blades are substantially identical.

4. The fitting according to claim 1 wherein said first pair of said blades is bent out of said base in the direction towards said crimping barrel.

5. The fitting according to claim 4 wherein each blade of said second pair of blades is bent out of a respective side wall in the direction away from said crimping barrel.

6. The fitting according to claim 4 wherein said second pair of blades are substantially identical.

* * * * *